US005478406A

United States Patent [19]

Derby et al.

[11] Patent Number: 5,478,406

[45] Date of Patent: Dec. 26, 1995

[54] METHOD AND APPARATUS FOR CLEANING FLEXIBLE CONTAINERS

[75] Inventors: Norwin C. Derby, Dallas; Michael D. Tipton, Garland, both of Tex.

[73] Assignee: Better Agricultural Goals Corp., Dallas, Tex.

[21] Appl. No.: 54,857

[22] Filed: Apr. 28, 1993

[51] Int. Cl.[6] ..... B08B 5/04

[52] U.S. Cl. ..... 134/16; 134/21; 134/22.1; 134/22.18; 15/304

[58] Field of Search ..... 15/304; 134/16, 134/21, 22.1, 22.18

[56] References Cited

U.S. PATENT DOCUMENTS 2,957,283 10/1960 Mitchell ..... 134/22.1 X

FOREIGN PATENT DOCUMENTS 720073 12/1954 United Kingdom .

*Primary Examiner*—David L. Lacey
*Assistant Examiner*—Sean Vincent
*Attorney, Agent, or Firm*—Michael A. O'Neil

[57] ABSTRACT

A method and apparatus for cleaning a flexible bulk container includes a dust collector having a negative pressure chamber connected through a vacuum hose to a fill spout support chamber to which a dirty container is connected in a substantially dust tight relationship. An exhaust blower of the dust collector is connected through a pressure hose to the fill spout support chamber. An alternating valve connected to the two hoses alternately disrupts fluid flow through one hose while allowing fluid flow through the remaining hose to alternately inflate and evacuate the dirty container connected to the fill spout support chamber. The alternate inflating and evacuation of the dirty container is repeated a predetermined number of times to remove the desired amount of particulate material from the dirty container. A third hose is connected to the dust collector for vacuuming the exterior of the dirty container.

2 Claims, 3 Drawing Sheets

METHOD AND APPARATUS FOR CLEANING FLEXIBLE CONTAINERS

TECHNICAL FIELD

This invention relates to method and apparatus for cleaning previously used flexible bulk containers, and more particularly to method and apparatus for dry cleaning a previously used container by alternately inflating and evacuating the container to dislodge and remove remaining particulate material.

BACKGROUND OF THE INVENTION

Flowable materials of all types are transported and stored, in flexible intermediate bulk containers made from a variety of materials, and having a variety of surface treatments. Most of the flexible containers are reusable or recyclable. Prior to reuse or recycling, particulate material remaining on the inside of the container must be removed.

Present methods for dry cleaning the containers are primarily manual. Some container users have resorted to suspending the containers and blowing a stream of air from end to end through the fill and discharge spouts of the containers. While the procedure may remove particulate material remaining in the container, it is difficult to control the collection and disposal of the material as it is blown from the container.

SUMMARY OF THE INVENTION

The apparatus of the present invention overcomes the foregoing and other problems associated with cleaning flexible containers by alternately inflating and creating a vacuum within the container for dislodging the material and evacuating the contents of the container for a more controlled removal and collection of the particulate material. A dust collector having both, vacuum and inflating capabilities is connected through a pair of hoses to a fill spout support chamber. The fill spout of a container is positioned and secured to surround the fill spout chamber in a substantially dust tight relationship.

One of the hoses is connected to direct the flow of air from the dust collector into the container through the fill spout chamber, while the other hose is connected for creating a vacuum in the container to evacuate the contents of the container through the fill spout chamber. An alternating valve connected to the hoses in line between the dust collector and the fill spout chamber closes the hose connected for creating a vacuum in the container while opening the hose connected for inflating the container.

After a predetermined time, the valve is actuated to close the hose connected for inflating the container, while opening the hose for creating a vacuum in the container. Thus, the container is alternately inflated to dislodge particles remaining within the container, and then deflated in a vacuum created therein to remove the dislodged particles, trapping them in the dust collector. The alternating inflation and vacuum cycles are repeated a predetermined number of times to remove as much of the particulate material as is necessary to reuse or recycle the container.

A third hose is connected at one end to the dust collector, with the remaining end adapted for receiving vacuum nozzles thereon for vacuuming the exterior of the container. Thus, the particulate material from the interior, as well as the exterior of, the container is collected in the dust container for clean, controlled disposal.

BRIEF DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION

Figure 1:
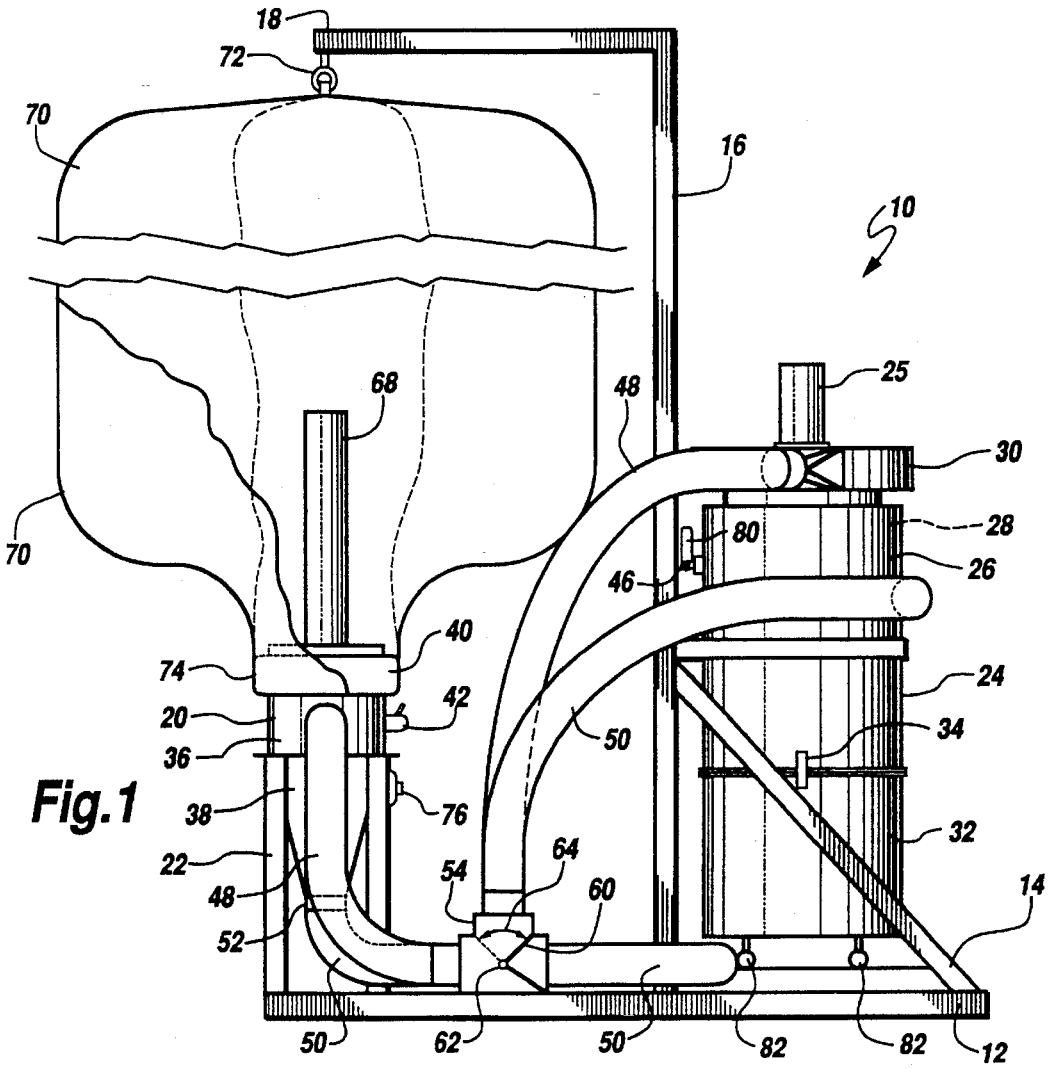
FIG. 1 is a side view of the apparatus for cleaning flexible containers of the present invention.

Referring now to the Drawings, and more particularly to FIG. 1 thereof, there is shown a bag cleaner 10 incorporating the apparatus for cleaning flexible containers of the present invention. A base 12, capable of being lifted by a forklift, has a dust collector support frame 14 mounted thereon. Extending upwardly from the dust collector support frame 14 is a height adjustable bag support frame 16. Mounted on the base 12, adjacent to the dust collector support frame 14 and in vertical alignment with the distal end 18 of the bag support frame 16, is a fill spout support chamber 20 mounted on a fill spout support stand 22.

A dust collector 24 is mounted to the dust collector support frame 14 and has a negative pressure chamber 26 connected through an internal filter 28 to an exhaust blower 30. Removably connected to the negative pressure chamber 26 is a waste disposal chamber or container 32, held in sealed relation with the negative pressure chamber 26 by clamps 34. The exhaust blower 30 of the dust collector 24 is powered by a motor 25.

The fill spout support chamber 20 has a circular chamber portion 36 and a conically tapered chamber portion 38 extending downwardly from the circular chamber portion 36. Surrounding the circular chamber portion 36 is an inflatable collar 40 connected through a first valve 42 and a pressure regulator 44 to a compressed air source.

Figure 2:
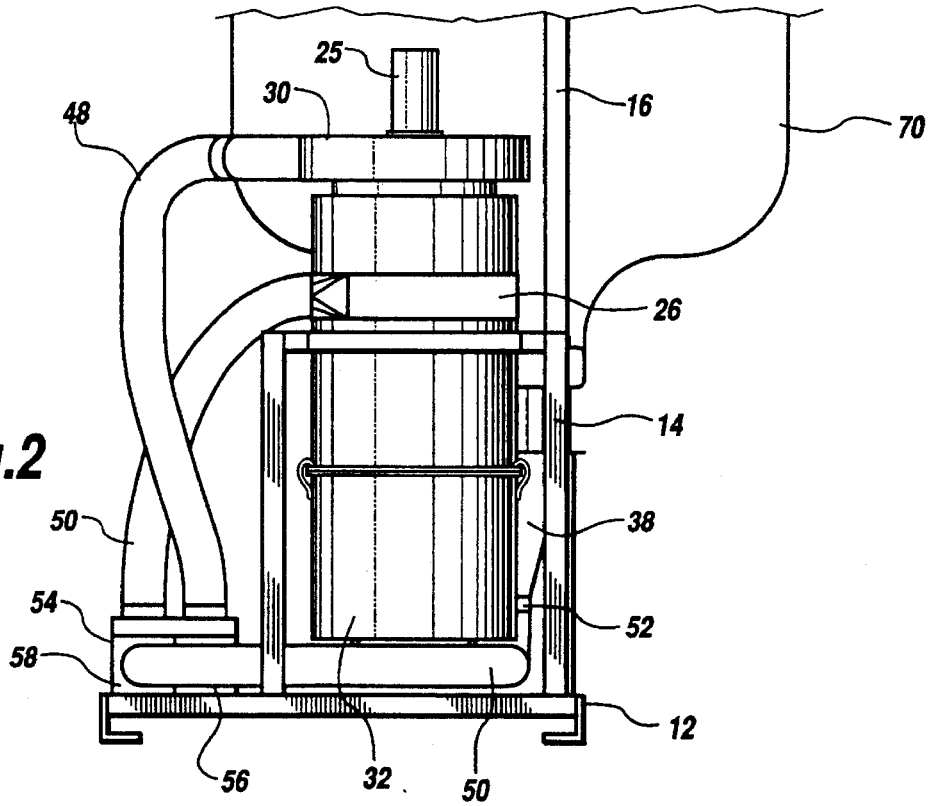
FIG. 2 is a partial back view of the apparatus of FIG. 1.
Figure 3:
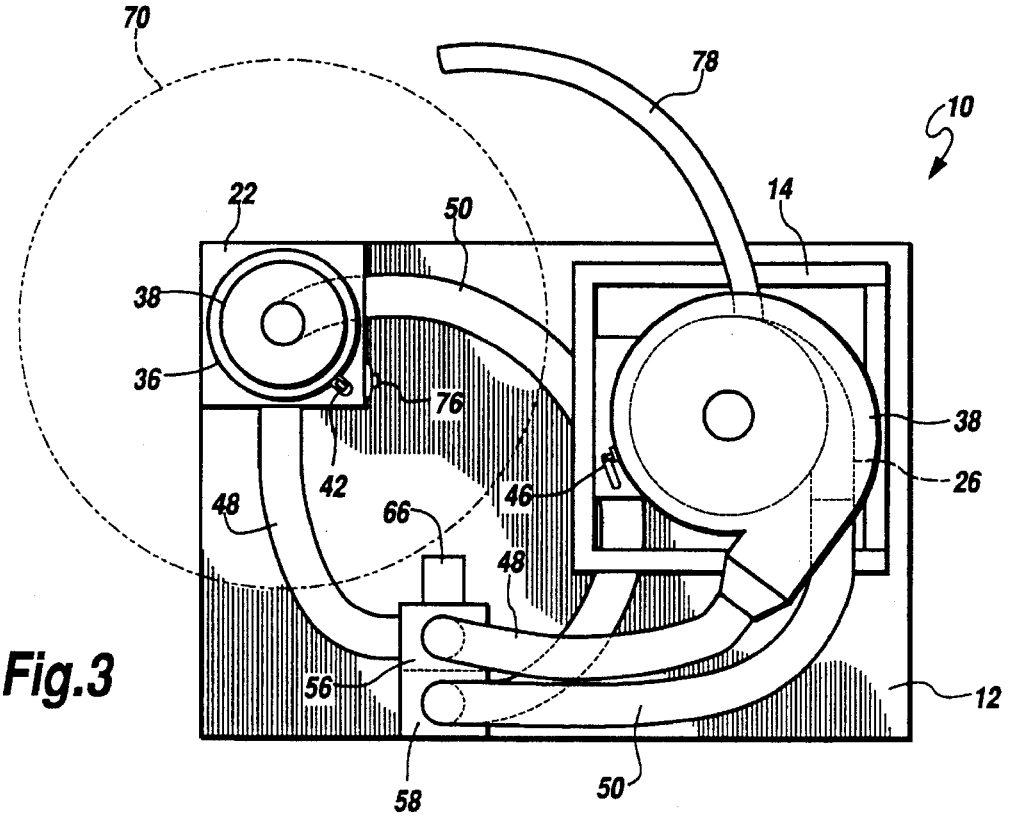
FIG. 3 is a top view of the apparatus of FIG. 1 with the bag support frame omitted.

Referring now to FIGS. 1, 2 and 3, the circular chamber portion 36 of the fill spout support chamber 20 is connected to the exhaust blower 30 through a pressure hose 48. A vacuum hose 50 extends from the distal end 52 of the conically tapered chamber portion 38 of the fill spout support chamber 20 to connect the fill spout support chamber 20 for fluid flow communication with the negative pressure chamber 26 of the dust collector 24.

Figure 4:
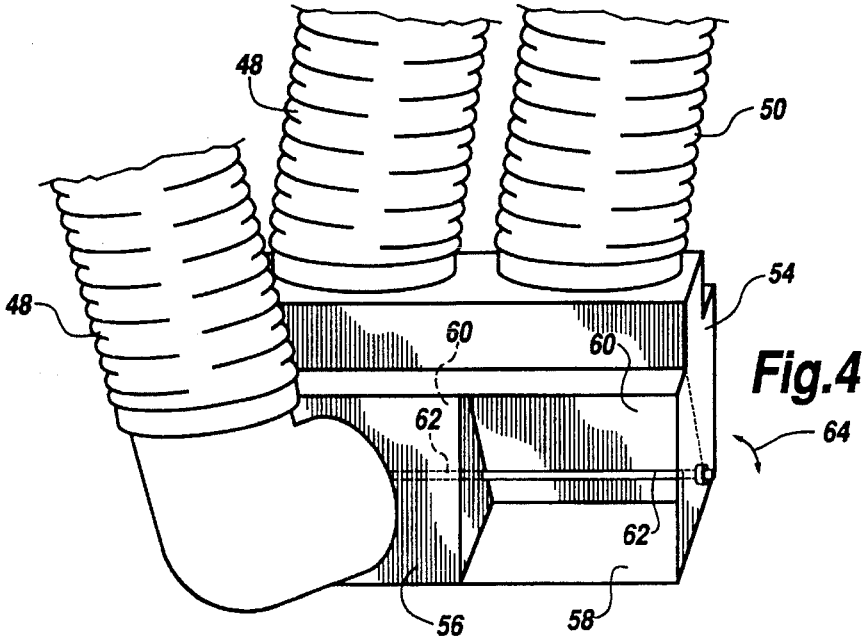
FIG. 4 is an enlarged view of the alternating valve for regulating the direction of the air flow of the apparatus of FIG. 1.

Referring now to FIGS. 1 through 4, an alternating valve 54 is connected to the pressure hose 48 and the vacuum hose 50 between the fill spout support chamber 20 and the dust collector 24. As shown in FIG. 4, the valve 54 has a pair of adjacent chambers 56 and 58 connected to pressure hose 48 and vacuum hose 50, respectively. Chambers 56 and 58 are positioned in a generally side-by-side relationship to one another with chamber 58 opened to the atmosphere in a generally forwardly facing direction, while chamber 56 is opened to the atmosphere in a generally rearwardly facing direction.

A blade 60 is fixedly mounted on a shaft. 62 extending through chambers 56 and 58 for vertical rotation in chambers 56 and 58 as indicated by a directional arrow 64. Timed actuation of a solenoid 66 rotates the shaft 62 such that the blade 60 is positioned to seal the opening to the atmosphere of chamber 56 to allow fluid flow through pressure hose 48 while interrupting fluid flow in vacuum hose 50 and opening chamber 58 to the atmosphere.

After a predetermined time, solenoid 66 causes shaft 62 to rotate such that blade 60, as shown in phantom in FIG. 1, seals chamber 58 for fluid flow through vacuum hose 50, while interrupting fluid flow through pressure hose 48 and opening chamber 56 to the atmosphere. Thus, fill spout support chamber 20 communicates with the dust chamber 24 through pressure hose 48 only when communication through vacuum hose 50 is disrupted, and communicates through vacuum hose 50 only when communication through pressure hose 48 is disrupted.

Referring again to FIGS. 1 and 3, an extension pipe 68 is mounted in the circular chamber portion 36 of the fill spout support chamber 20 and is connected to the pressure hose 48. A dirty container 70 is attached to a tension clamp 72 suspended from the bag support frame 16, and the fill spout 74 of the container 70 placed over the inflatable collar 40 surrounding the circular chamber portion 36 of the fill spout support chamber 20. The valve 42 is actuated to inflate collar 40, thereby retaining the fill spout 74 of the container 70 in substantially dust tight relationship with the fill spout support chamber 20.

The motor 25 is then actuated to cycle air through the dust collector 24. Solenoid 66 rotates shaft 62, positioning blade 60 to open fluid flow communication in pressure hose 48, forcing air from the exhaust blower 30 through extension pipe 68 into the interior of the dirty container 70, thereby inflating the container 70 as shown in FIGS. 1 and 3. Although the container is shown in phantom in FIG. 3 as being circular, the drawing is for purposes of illustration only, the shape of the inflated container 70 depending upon the particular type of container being cleaned.

After a predetermined period of time, the solenoid 66 automatically rotates shaft 62 to interrupt fluid flow through pressure hose 48 and open fluid flow through vacuum hose 50, thereby creating a vacuum in container 70 to remove particulate material dislodged by prior inflating of the container 70. The alternate inflating and evacuating of the container is repeated a predetermined number of times depending upon the size of the container being cleaned and the type of particulate material previously contained therein.

The shape of the fill spout support chamber 20 allows the dislodged particulate material to settle into the conically tapered chamber portion 38 to be removed during the evacuation portion of the cleaning cycle. Inflation of the container through extension pipe 68 prevents disturbance of particulate material that may have settled into the conically tapered chamber portion 38 of the fill spout support chamber 20. As the particulate material is removed through vacuum hose 50 it is deposited into the waste disposal chamber 32 mounted below the negative pressure chamber 26 of the dust collector 24. Retaining the container 70 in a generally longitudinally extended orientation allows expansion and compression of the container 70 without trapping the particulate material in folds of the collapsed container 70, as shown in phantom in FIG. 1.

Referring now to FIGS. 1 and 3, a switch 76 deactuates the solenoid 66 to halt the rotation of shaft 62. A third hose 78, as shown in FIG. 3, is connected to the negative pressure chamber 26 of the dust collector 24 for vacuuming the exterior of the dirty container 70. The flow control valve 46 may be opened by actuation of a lever 80 to regulate the rate of occurence of a reversed flow air blast through internal filter 28 to flush particulate material from the filter 28, thereby facilitating the flow of air from the negative pressure chamber 26 through the filter 28 and out exhaust blower 30.

Figure 5:
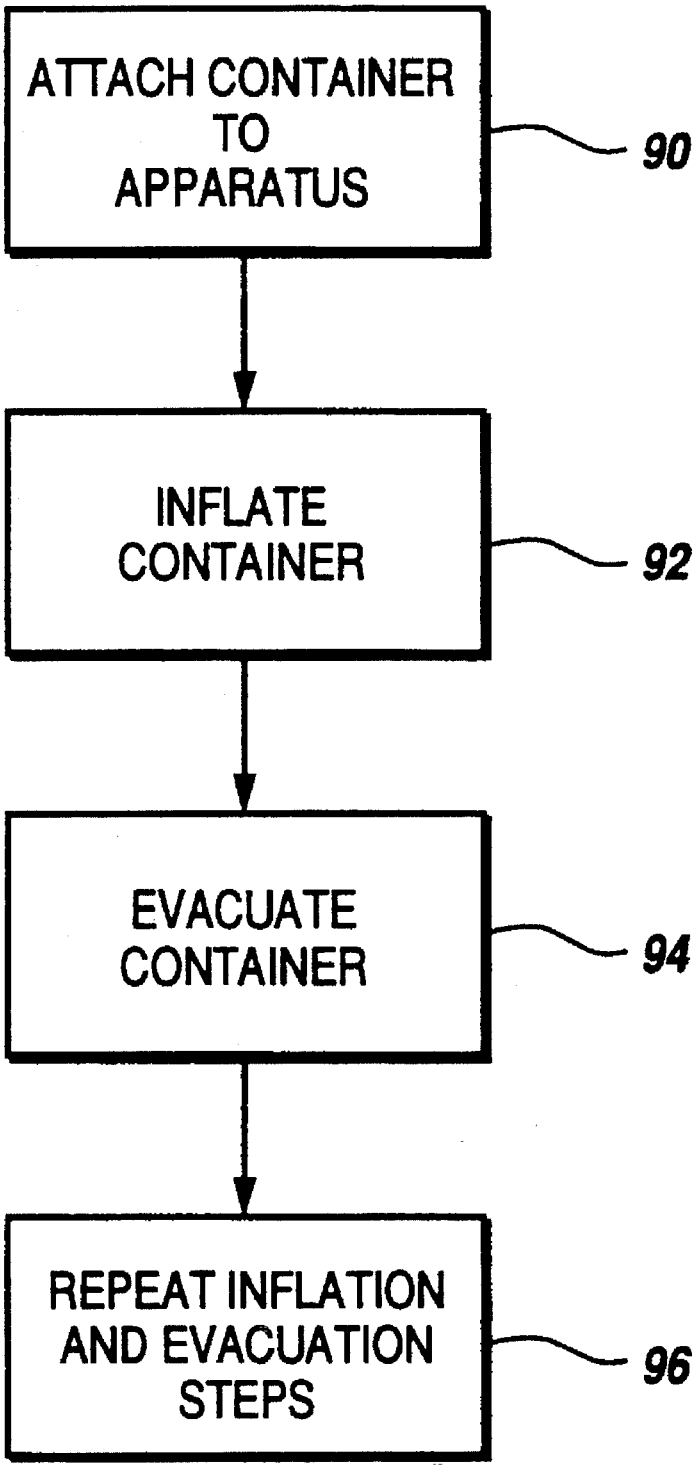
FIG. 5 is a flow chart of the method steps for cleaning a flexible container with the apparatus of FIG. 1.

Referring now to FIGS. 1 and 5, the method for cleaning a dirty container using the bag cleaner 10 includes suspending the dirty container 70 from the bag support frame 16, placing the fill spout 74 of the container 70 over the circular chamber portion 36 of the fill spout support chamber 20, and inflating the collar 40 to retain the fill spout 74 in substantially dust tight relationship with the fill spout support chamber 20, as represented at block 90 of the flow chart of FIG. 5. The motor 25 is actuated to generate fluid flow through the dust collector 24. Solenoid 66 is actuated to rotate shaft 62 to position blade 60 to open fluid flow through pressure hose 48 and stop fluid flow through vacuum hose 50, thereby inflating container 70, as represented at block 92 of the flow chart of FIG. 5.

After a predetermined time period, solenoid 66 rotates shaft 62 to position blade 60 to open fluid flow through vacuum hose 50 and stop fluid flow through pressure hose 48, thereby creating a vacuum to evacuate the contents of container 70, as represented at block 94 of the flow chart of FIG. 5. After a predetermined period of time, the shaft 62 is again rotated to position blade 60 to open fluid flow through pressure hose 48 and stop fluid flow through vacuum hose 50, to again inflate container 70.

The steps of inflating and evacuating container 70 are repeated a predetermined number of times to remove the amount of particulate material required to reuse or recycle the dirty container 70, as represented at block 96 of the flow chart of FIG. 5. The number of repetitions required depends upon the size of the container 70 being cleaned and the type of particulate material contained therein.

When the waste disposal chamber 32 is full, the clamps 34 are released and the chamber removed for disposal of the waste contained therein. To facilitate removal of the filled waste disposal chamber 32 from the base: 12, a number of casters 82 may be mounted to the bottom of chamber 32. A liner, such as a heavy weight garbage bag may be placed in the chamber 32 to facilitate disposal of the particulate waste material collected therein.

Although the preferred embodiment of the present invention has been illustrated in the accompanying Drawings and described in the foregoing Detailed Description, it will be appreciated by those skilled in the art that various modifications and rearrangements of the component parts and elements of the present invention are possible within the scope of the present invention.

We claim:

1. Apparatus for dry cleaning a flexible bulk container, comprising:

a waste disposal container;

a dust collector having an exhaust blower for connection in a dust tight relationship to a flexible container through a pressure hose for inflating the flexible container to dislodge particulate material in the container;

an evacuation means having a negative pressure chamber connected in a dust tight relationship to the flexible container through a vacuum hose for evacuating the container to remove the dislodged particulate material;

means connecting the evacuation means to the waste disposal container for depositing in the waste disposal container the particulate material removed from the flexible container;

means for alternating the inflation and evacuation of the container a number of times to remove particulate material for dry cleaning of the container; and a third hose connected to the negative pressure chamber of the evacuation means for vacuuming the exterior of the container with the distal end of the third hose.

2. A method for dry cleaning a flexible bulk container comprising the steps of:

connecting the flexible container in a dust tight flow relationship through a vacuum hose and a pressure hose to a dust collector having a negative pressure chamber, an exhaust blower, and a waste disposal chamber;

alternately opening one of said hoses while closing the other of said hoses to alternately inflate the container to dislodge particulate material therein and evacuate the container to remove the dislodged particulate material thereby depositing the removed particulate material in the waste disposal chamber;

repeating the step of alternately opening and closing the hoses to alternately inflate and evacuate the container a number of times to remove a desired amount of remaining particulate material to achieve a dry cleaning of the container; and retaining the container in a longitudinally extended orientation to facilitate removal of the dislodged particulate material.

* * * * *